US007188707B2

(12) United States Patent
Bothwell et al.

(10) Patent No.: US 7,188,707 B2
(45) Date of Patent: Mar. 13, 2007

(54) SCAFFOLD PLANK WITH END CONNECTOR AND METHOD OF MAKING THE SAME

(75) Inventors: Timothy B. Bothwell, Riverside, CA (US); Roy Watson, Norwalk, CT (US)

(73) Assignee: Bothwell Enterprises, Inc., Upland, CA (US)

( * ) Notice: Subject to any disclaimer, the term of this patent is extended or adjusted under 35 U.S.C. 154(b) by 0 days.

(21) Appl. No.: 11/246,946

(22) Filed: Oct. 7, 2005

(65) Prior Publication Data

US 2006/0054400 A1 Mar. 16, 2006

Related U.S. Application Data

(63) Continuation of application No. 10/656,818, filed on Sep. 5, 2003, which is a continuation-in-part of application No. 10/147,792, filed on May 17, 2002, now abandoned, which is a continuation of application No. 09/614,079, filed on Jul. 11, 2000, now Pat. No. 6,431,316.

(60) Provisional application No. 60/143,535, filed on Jul. 13, 1999.

(51) Int. Cl.
*E04G 1/15* (2006.01)

(52) U.S. Cl. ..... 182/222; 182/178.1; 182/119

(58) Field of Classification Search ..... 182/222, 182/223, 119, 178.1, 179.1
See application file for complete search history.

(56) References Cited

U.S. PATENT DOCUMENTS

| | | | | |
|---|---|---|---|---|
| 225,737 | A | 3/1880 | De Vaney | |
| 1,516,347 | A | 11/1924 | Pataky | |
| 1,975,262 | A | 10/1934 | Evans | |
| 2,225,737 | A | 12/1940 | De Vaney | |
| 2,261,831 | A * | 11/1941 | Farr et al. | 182/223 |
| 2,981,365 | A * | 4/1961 | Olsen | 182/223 |
| 3,964,221 | A | 6/1976 | Berquist | |
| 4,496,029 | A | 1/1985 | Kuroda | |
| 4,802,553 | A | 2/1989 | Waters et al. | |
| 4,852,691 | A | 8/1989 | Bruno | |
| D342,329 | S | 12/1993 | Barre et al. | |
| 5,596,933 | A | 1/1997 | Knight et al. | |
| 5,624,620 | A | 4/1997 | Turner | |
| 5,783,286 | A | 7/1998 | Di Nicola | |
| 5,810,114 | A * | 9/1998 | White | 182/178.5 |
| 5,850,720 | A | 12/1998 | Willis | |
| 5,882,136 | A | 3/1999 | Pyritz et al. | |
| 5,887,331 | A | 3/1999 | Little | |
| 6,131,700 | A | 10/2000 | Farner | |
| 6,194,051 | B1 | 2/2001 | Gagas | |
| 6,554,528 | B2 * | 4/2003 | Chelko | 403/364 |

FOREIGN PATENT DOCUMENTS

EP 250612 A1 1/1988

(Continued)

*Primary Examiner*—Alvin Chin-Shue
(74) *Attorney, Agent, or Firm*—Stetina Brunda Garred & Brucker

(57) ABSTRACT

A scaffold plank assembly for engagement to a scaffolding frame. The scaffold plank assembly comprises an elongate, non-metal plank defining opposed first and second ends and at least one interior cavity. Attached to respective ones of the opposed ends of the plank is a pair of end connectors. Each of the end connectors comprises a main body defining an arcuate body engagement surface, and at least two arms which are attached to the main body. Each of the arms also defines an arcuate arm engagement surface which is substantially continuous with the body engagement surface. Attached to and extending from the main body is at least one attachment finger which is extensible into the interior cavity of the plank. The body and arm engagement surfaces are sized and configured to be cooperatively engageable to the scaffolding frame.

19 Claims, 8 Drawing Sheets

FOREIGN PATENT DOCUMENTS

| | | | |
|---|---|---|---|
| EP | 347476 | A1 | 12/1989 |
| EP | 348885 | A2 | 1/1990 |
| GB | 1148927 | | 4/1969 |
| GB | 2234003 | | 1/1991 |

* cited by examiner

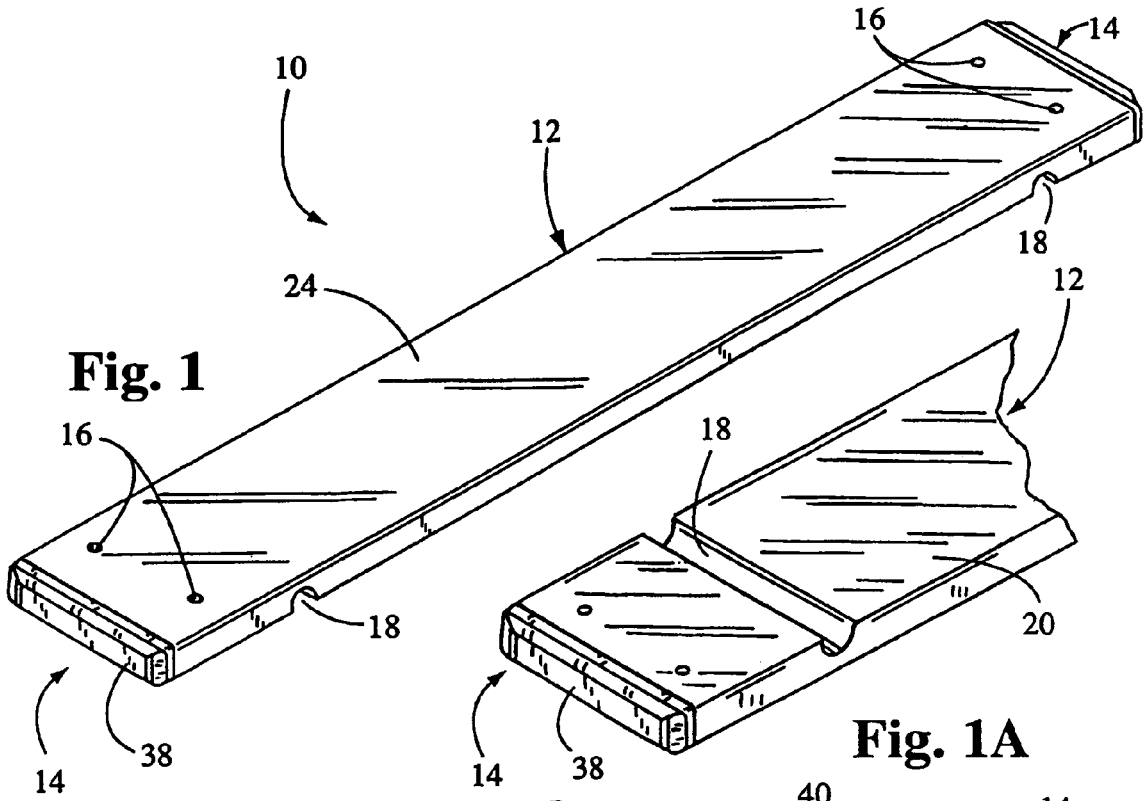
Fig. 1
Fig. 1A
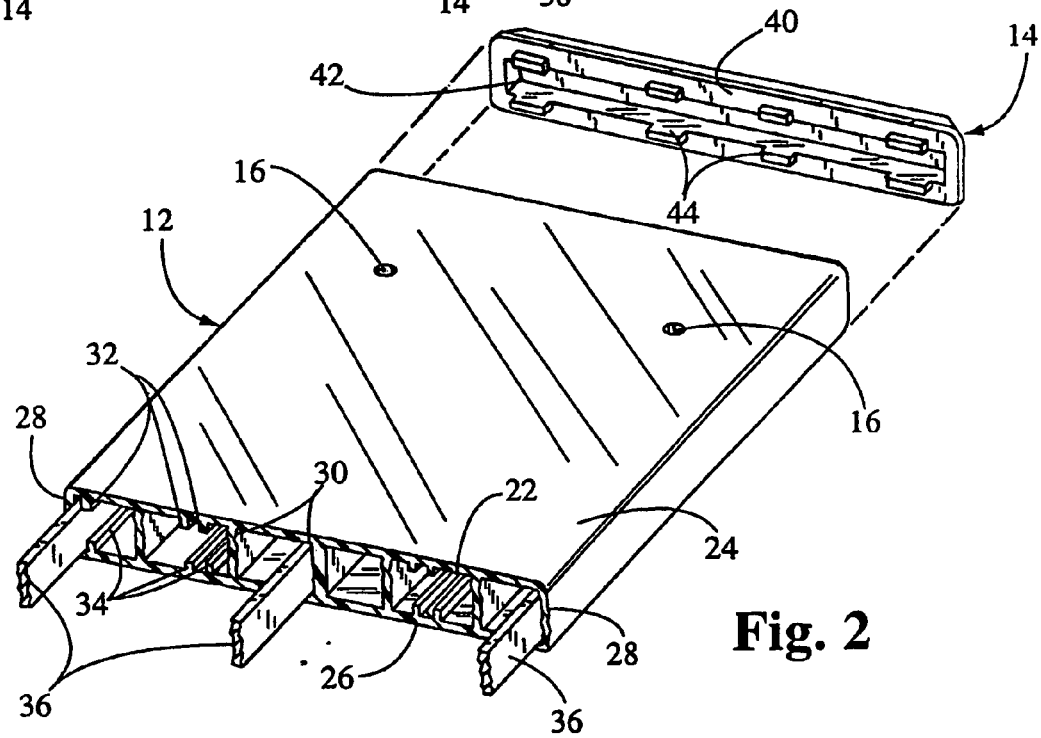
Fig. 2

SCAFFOLD PLANK WITH END CONNECTOR AND METHOD OF MAKING THE SAME

CROSS-REFERENCE TO RELATED APPLICATIONS

The present application is a continuation of U.S. application Ser. No. 10/656,818 entitled SCAFFOLD PLANK WITH END CONNECTOR AND METHOD OF MAKING SAME filed Sep. 5, 2003, which is a continuation-in-part of U.S. application Ser. No. 10/147,792 entitled SCAFFOLD PLANK AND METHOD OF MAKING SAME filed May 17, 2002 and now abandoned, which is a continuation of U.S. application Ser. No. 09/614,079 entitled IMPROVED SCAFFOLD PLANK AND METHOD OF MAKING SAME filed Jul. 11, 2000 and issued as U.S. Pat. No. 6,431,316 on Aug. 13, 2002, which claims priority to U.S. Provisional Application Ser. No. 60/143,535 entitled IMPROVED SCAFFOLD PLANK AND METHOD OF MAKING THE SAME filed Jul. 13, 1999.

STATEMENT RE: FEDERALLY SPONSORED RESEARCH/DEVELOPMENT

Not Applicable

BACKGROUND OF THE INVENTION

The present invention relates generally to scaffolding systems, and more particularly to a scaffold plank fabricated from a plastic material and optionally including end connectors which are configured to facilitate the firm engagement of the plank to a support frame structure.

As is well known in the building industry, scaffolding is virtually always employed during various facets of exterior and/or interior building construction or refurbishment. Known scaffolding systems typically comprise steel support frame structures which are selectively engageable to each other in a stacked fashion for achieving a desired overall height. In addition to the support frame structures, the scaffolding system includes a multiplicity of elongate scaffold planks, each of which is horizontally extensible between a respective pair of the support frame structures. The prior art scaffold planks are most typically fabricated from wood. Indeed, the use of wood for the prior art scaffold planks has been a long standing tradition in the building industry Though wood scaffold planks have been and continue to be generally suitable for use in scaffolding systems, the use of wood for the scaffolding planks gives rise to certain shortcomings and deficiencies which detract from their overall utility. More particularly, scaffold planks fabricated from wood are susceptible to splitting as well as to dry rot. Additionally, when exteriorly used scaffolding systems are subjected to rain or thunder storms as often occurs, the resultant water soaking of the wood scaffold planks virtually doubles their weight as compared to when dry, thus substantially increasing the difficulty by which they are moved or otherwise manipulated. Such water soaking of the wood scaffold planks also often results in the warping or twisting thereof. As will be recognized, due to their susceptibility to splitting, dry rot and warping/twisting, the prior art wood scaffold planks have a reasonably limited life span and require moderately frequent replacement.

Another drawback associated with the use of wood scaffold planks is the common occurrence of scaffold setters experiencing splinters in their hands when working with the same. Indeed, occurrences of splinters can reach a level of severity resulting in the initiation of a workers compensation claim. Moreover, because nails are also often used in conjunction with wood scaffold planks, workers are more susceptible to being injured by nails which are left there within.

A further problem associated with the use of wood scaffold planks is the relatively high cost thereof attributable to diminishing supplies of lumber. Indeed, ongoing extensive worldwide deforestation and the related environmental and ecological problems has, in addition to resulting in increases in the price of lumber, stimulated a movement to adopt lumber alternatives for purposes of contributing to the conservation and restoration of forests. These diminishing supplies of lumber also frequently give rise to delays in the delivery of lumber raw material to those mills which manufacture wood scaffold planks, thus resulting in periodic problems in meeting the supply demands of the building industry. Though metal (e.g., aluminum) scaffold planks have been developed in the prior art as an alternative to wood planks, such aluminum planks are extremely costly. Additionally, both the wood and aluminum scaffold planks of currently known scaffolding systems lack connectors which are suited to allow the plank to be quickly and easily engaged to a support frame structure.

The present invention addresses these concerns by providing a scaffold plank which is manufactured or fabricated from a plastic material and may optionally be provided with end connectors which are specifically sized and configured to facilitate the quick and easy interface of the plank to a scaffolding system support frame structure. As will be discussed below, the plastic scaffold plank of the present invention, though possessing the same level of structural integrity or rigidity as the prior art wood scaffold planks, does not have the same susceptibility to splitting, dry rot or warping/twisting. Additionally, the weight of the scaffold plank of the present invention is the same whether wet or dry. The use of plastic for the scaffold planks of the present invention also eliminates occurrences of splinters, and substantially eliminates injuries potentially caused by nails left therein. Further, since the scaffold planks of the present invention may be fabricated from recycled/recyclable plastic material, they address the need of recycling used plastic into a useful product, in addition to satisfying the increasing desire in industry for lumber alternatives. These, and other features of the present invention will be described in more detail below.

BRIEF SUMMARY OF THE INVENTION

In accordance with the present invention, there is provided a scaffold plank assembly for engagement to a scaffolding frame. The scaffold plank assembly comprises an elongate, non-metal plank which defines opposed first and second ends and at least one interior cavity. Attached to respective ones of the opposed ends of the plank is a pair of end connectors. The end connectors each comprise a main body defining an arcuate engagement surface, and at least two arms which are attached to the main body. Each of the arms defines an arcuate engagement surface which is substantially continuous with the body engagement surface. Attached to and extending from the main body is at least one attachment finger which is extensible into the interior cavity of the plank. The body and arm engagement surfaces are sized and configured to be cooperatively engageable to the scaffolding frame.

In addition to the arcuate body engagement surface, the main body includes at least two notches formed therein. The notches are sized and configured to receive respective ones of the arms of another end connector in a nesting fashion, thus allowing the end connectors of two adjacent scaffold planks to be cooperatively engaged to a common support bar of the scaffolding frame.

BRIEF DESCRIPTION OF THE DRAWINGS

These, as well as other features of the present invention, will become more apparent upon reference to the drawings wherein:

FIG. 1 is a top perspective view of a scaffold plank constructed in accordance with a first embodiment of the present invention;

FIG. 1A is a partial bottom perspective view of the scaffold plank shown in FIG. 1, illustrating the optional inclusion of a frame setting notch in the underside thereof;

FIG. 2 is a partial top perspective, cut-away view of the scaffold plank constructed in accordance with the first embodiment of the present invention, illustrating its end cap as being exploded from the main body thereof;

DETAILED DESCRIPTION OF THE INVENTION

Figure 2A:
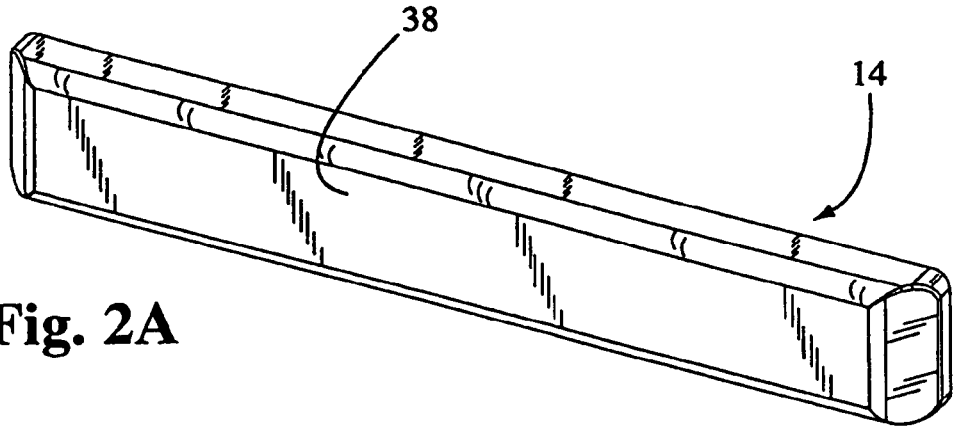
FIG. 2A is a front perspective view of the end cap of the scaffold plank of the first embodiment of the present invention, the rear perspective view of the end cap being shown in FIG. 2.

Referring now to the drawings wherein the showings are for purposes of illustrating preferred embodiments of the present invention only, and not for purposes of limiting the same, FIG. 1 perspectively illustrates a scaffold plank 10 constructed in accordance with a first embodiment of the present invention. The scaffold plank 10 has an elongate, generally rectangular configuration and includes a main body 12 which defines opposed ends. Attached to the respective ones of the opposed ends of the main body 12 is a pair of identically configured end caps 14, the precise structural attributes of which will be described in more detail below. In the first embodiment, the preferred height or thickness of the scaffold plank 10 is in the range of from about 1.0 inch to about 2.50 inches, and is preferably about 1.50 inches. The preferred width of the scaffold plank 10 is in the range of from about 6.0 inches to about 15.0 inches, and is preferably about 9.50 inches. The overall length of the scaffold plank 10 (including the main body 12 and end caps 14) is variable. In this respect, it is contemplated that the scaffold plank 10 may be provided to have an overall length of either 6 feet, 9 feet, 12 feet, or 16 feet. However, those of ordinary skill in the art will recognize that the scaffold plank 10 of the present invention may be fabricated to have length, width, and/or height dimensions differing from those described above.

As seen in FIGS. 1 and 1A, the scaffold plank 10 may be provided with two pairs of pre-formed nail holes 16, with each pair of the nail holes 16 being disposed within the body 12 in relative close proximity to a respective one of the end caps 14. In addition to the nail holes 16, the main body 12 of the scaffold plank may be formed to include a spaced pair of arcuately contoured, concave frame setting notches 18 in the underside or bottom surface 20 thereof. As will be described in more detail below, the nail holes 16 and/or frame setting notches 18, if included, are preferably formed in the main body 12 via finishing operations conducted subsequent to the fabrication of the main body 12. The nail holes 16 and/or frame setting notches 18 are used to facilitate the engagement or interface of the scaffold plank 10 to a conventional steel frame support structure of a scaffolding system.

Referring now to FIGS. 2 and 2A, the main body 12 of the scaffold plank 10 itself comprises a top wall 22 which defines a top surface 24, a bottom wall 26 which defines the bottom surface 20, and an opposed pair of longitudinally extending sidewalls 28 which are integrally connected to the top and bottom walls 22, 26. Integrally connected to and extending perpendicularly between the top and bottom walls 22, 26, and in particular the inner surfaces thereof, are five (5) reinforcement webs 30. The reinforcement webs 30 extend in generally parallel relation to each other, thus defining six (6) compartments of cavities which extend longitudinally within the interior of the main body 12. In the scaffold plank 10, the preferred thickness of the top, bottom and sidewalls 22, 26, 28 and reinforcement webs 30 is approximately 0.1875 inches.

As further seen in FIG. 2, formed on the inner surface of the top wall 22 and extending longitudinally therealong in spaced, generally parallel relation to each other are seven (7) ribs 32. Similarly, formed on and extending longitudinally along the inner surface of the bottom wall 26 in spaced, generally parallel relation to each other are seven (7) ribs 34 which are disposed in opposed, aligned relation to respective ones of the ribs 32. The ribs 32, 34 extend generally perpendicularly from the inner surfaces of the top and bottom walls 22, 26, respectively. In the scaffold plank 10, the top, bottom and sidewalls 22, 26, 28 and ribs 32, 34 extending within the outermost pair of cavities collectively form a pair of slots which are each adapted to accommodate an elongate, rectangularly configured reinforcement bar 36. The centermost pair of ribs 32, 34, top and bottom walls 22, 26, and centermost reinforcement web 30 also collectively define a slot which is adapted to accommodate a third reinforcement bar 36. The four remaining ribs 32 and four remaining ribs 34 collectively define two more slots which extend within respective ones of those cavities disposed adjacent the outermost pair and are adapted to accommodate two additional reinforcement bars 36. In the scaffold plank 10, the reinforcement bars 36 are each preferably fabricated from steel having a thickness of approximately 0.1875 inches.

In the scaffold plank 10 shown in FIG. 2, three (3) reinforcement bars 36 are depicted as being disposed within respective ones of the five (5) slots extending within the interior of the main body 12. Those of ordinary skill in the art will recognize that no reinforcement bars 36 need to be provided within the main body 12, and that less than three or up to five reinforcement bars 36 may be included therein. The number of reinforcement bars 36, if any, included in the interior of the main body 12 of the scaffold plank 10 is dependent upon the level of structural integrity or rigidity desired in relation thereto. In the scaffold plank 10, each of the reinforcement bars 36 is preferably sized such that when disposed within the interior of the main body 12 in the above-described manner, the opposed ends thereof do not protrude beyond respective ones of the opposed ends of the main body 12.

As indicated above, in addition to the main body 12, the scaffold plank 10 includes the end caps 14 which are attached to respective ones of the opposed ends of the main body 12. As seen in FIGS. 2 and 2A, each of the end caps 14 has a generally rectangular configuration, and includes an outer surface 38 which defines a pair of beveled or concave corner regions adjacent respective ones of the lateral sides thereof. In addition to the outer surface 38, each end cap 14 has an inner surface 40 which includes an elongate channel 42 formed therein. The channel 42 is formed within each end cap 14 for purposes of reducing the overall weight thereof. As seen in FIG. 2, the channel 42 terminates inwardly of the lateral sides of the end cap 14.

Formed on the inner surface 40 of each end cap 14 are a total of eight (8) rectangularly configured attachment tabs 44. The attachment tabs 44 are arranged in two sets of four, with the attachment tabs 44 of each set being disposed in spaced relation to each other along a respective one of the longitudinal sides of the channel 42. Additionally, the attachment tabs 44 of one set are disposed in opposed, linear alignment with respective ones of the attachment tabs 44 of the other set. Importantly, the attachment tabs 44 are oriented so as to be advanceable into respective ones of the cavities defined within the main body 12 and not interfere with any of the reinforcement webs 30 thereof. In this respect, the attachment tabs 44 are sized and configured such that when each opposed pair thereof is received into a respective one of the cavities of the main body 12, those edges of the attachment tabs 44 disposed furthest from the channel 42 are in abutting contact with the inner surfaces of respective ones of the top and bottom walls 22, 26 of the main body 12. Those of ordinary skill in the art will recognize that different numbers of attachment tabs 44 arranged in alternative patterns are contemplated in relation to the end caps 14. In the scaffold plank 10, each of the end caps 14 may be sonically welded to the main body 12, or may alternatively be attached to the main body 12 through the use of fasteners such as pins, snap fit, or an adhesive. However, those of ordinary skill in the art will recognize that other methods may be employed to facilitate the attachment of the end caps 14 to the main body 12. As is seen in FIG. 1, the end caps 14 are sized relative to the main body 12 such that when attached thereto, the longitudinal sides of the end caps 14 are substantially flush with the bottom surface 20 of the bottom wall 26 and top surface 24 of the top wall 22, with the lateral sides of the end caps 14 being substantially flush with respective ones of the outer surfaces of the sidewalls 28.

Both the main body 12 and end caps 14 of the scaffold plank 10 are preferably fabricated from a plastic material. A preferred plastic material is a ten percent to fifty percent glass-filled polypropylene/nylon blend. Such plastic material may alternatively comprise either virgin or recycled plastic. It is contemplated that the plastic or nylon material may be filled with either glass or another suitable reinforcement material to increase the structural integrity/rigidity thereof. Those of ordinary skill in the art will further recognize that the main body 12 and end caps 14 need not necessarily be fabricated from identical materials. In this respect, each of the end caps 14 could be fabricated from a metallic material such as aluminum. As indicated above, each of the reinforcement bars 36 is preferably fabricated from steel.

Additionally, the main body 12 of the scaffold plank 10 is preferably fabricated via an extrusion process. If one or more reinforcement bars 36 is to be included within the interior of the main body 12, it is preferred that the plastic material used to form the main body 12 will be extruded about the reinforcement bar(s) 36. However, those of ordinary skill in the art will recognize that the reinforcement bars 36 may be inserted into the interior of the main body 12 via a separate procedure which is conducted subsequent to the formation of the main body 12 via the extrusion process. The end caps 14 are preferably fabricated through the use of an injection molding or vacuum forming process and, as indicated above, secured to respective ones of the opposed ends of the main body 12 subsequent to the fabrication of the same.

Subsequent to the fabrication of the main body 12 via the extrusion process, it is contemplated that the nail holes 16 may be formed therein via a follow-up drilling operation. Additionally, the frame setting notches 18 may be formed in the bottom surface 20 via a follow-up grinding or machining operation. Moreover, the top surface 24 of the top wall 22 may be subjected to a grinding or machining operation for purposes of applying a texture or roughened feature thereto. Though not shown, it is further contemplated that the cavities defined by the main body 12 may be filled with structural foam or some equivalent thereto prior to the attachment of the end caps 14 to the main body 12 for purposes of increasing the structural strength or rigidity of the completed scaffold plank 10.

Figure 3:
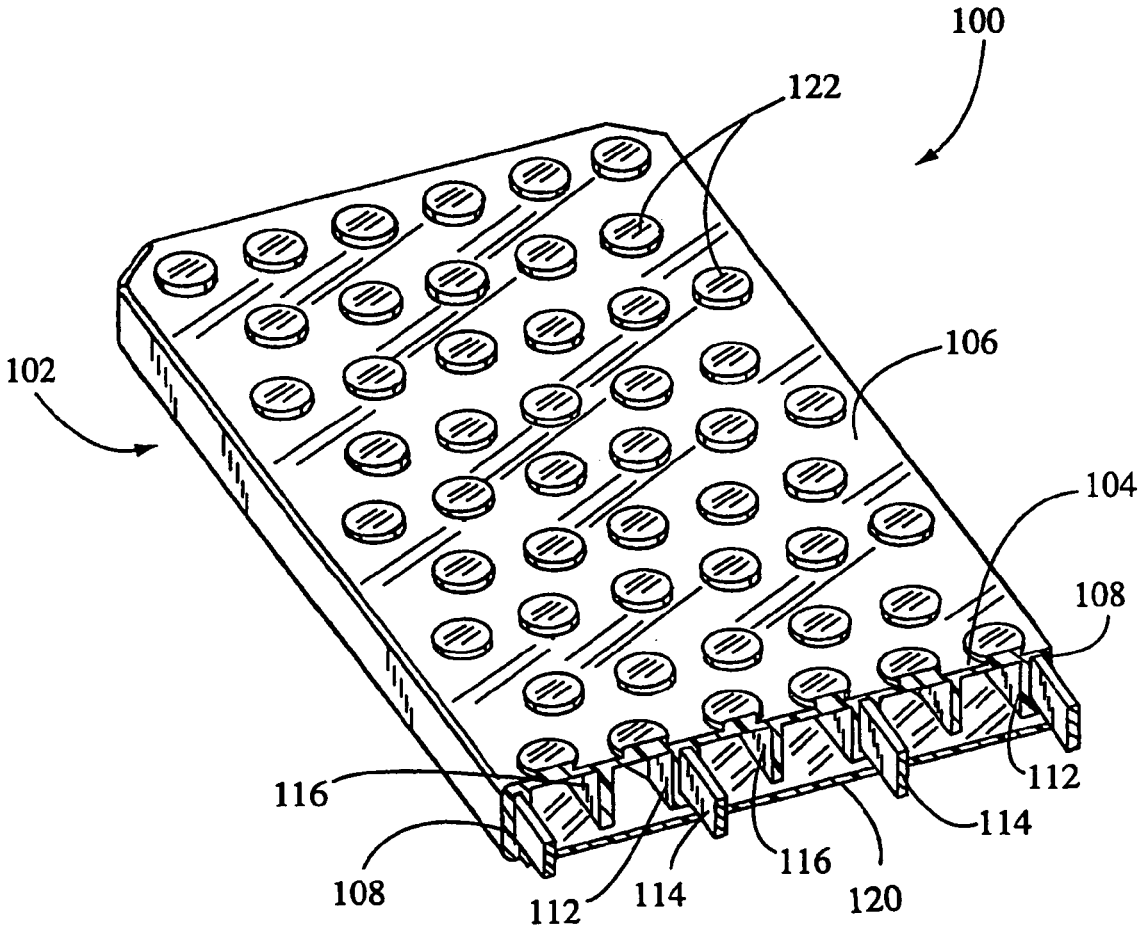
FIG. 3 is a partial top perspective, cut-away view of a scaffold plank constructed in accordance with a second embodiment of the present invention.
Figure 4:
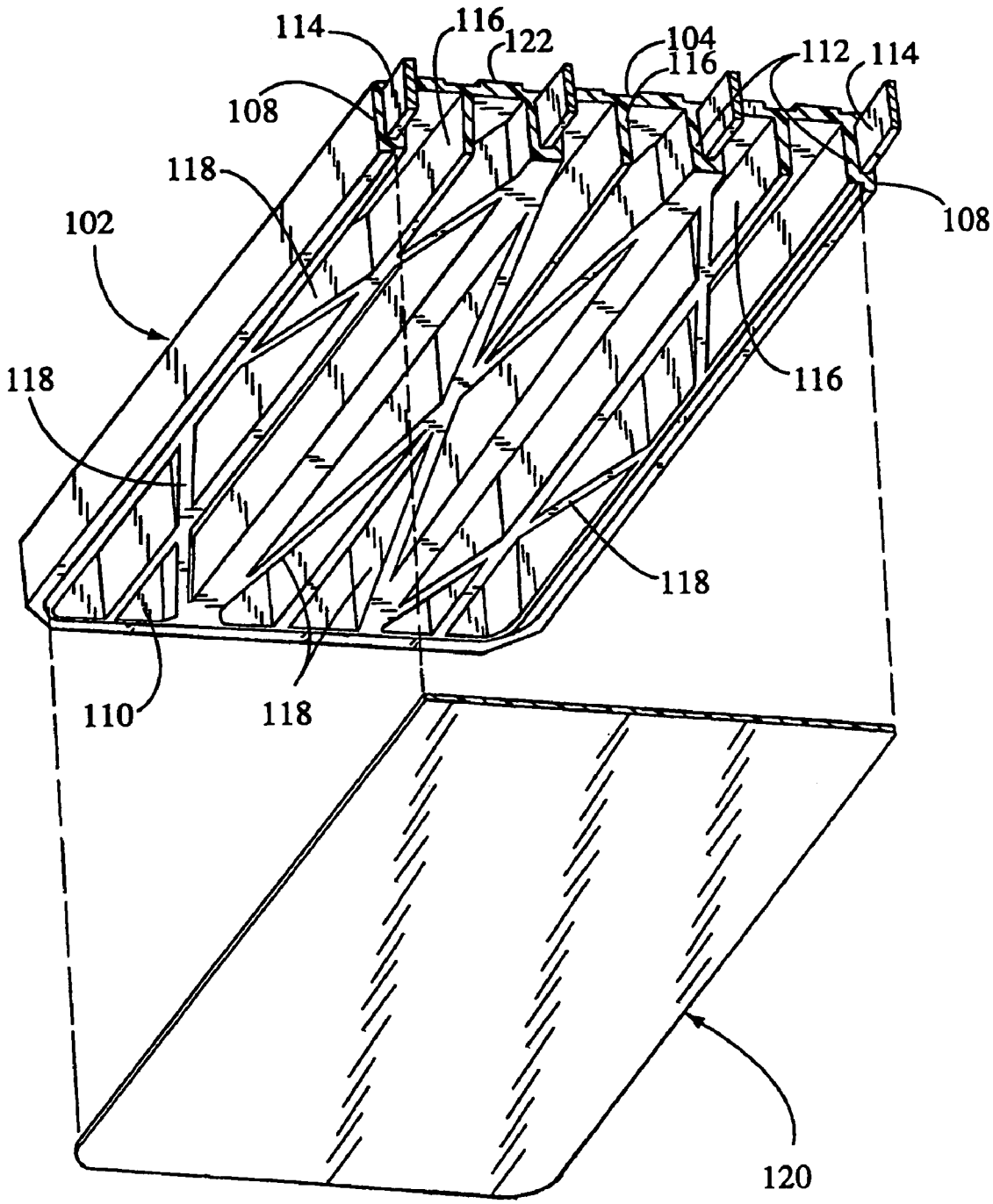
FIG. 4 is a partial bottom perspective, cut-away view of the scaffold plank shown in FIG. 3, illustrating its bottom cover as being exploded from the main body thereof.

Referring now to FIGS. 3 and 4, there is depicted a scaffold plank 100 constructed in accordance with a second embodiment of the present invention. The scaffold plank 100 also has an elongate, generally rectangular configuration and includes a main body having a top wall 104 which defines a top surface 106, an opposed pair of longitudinally extending sidewalls 108 which are integrally connected to the top wall 104, and an opposed pair of end walls 110 which are integrally connected to the top and sidewalls 104, 108 and define respective ones of the opposed ends of the scaffold plank 100. Though the scaffold plank 100 of the second embodiment preferably does not include the previously described end caps 14 since the opposed ends thereof are defined by the end walls 100 of the main body 102, those of ordinary skill in the art will recognize that such end caps 14 may be employed as an alternative to the integrally formed end walls 100. Similar to the configuration of the outer surfaces 38 of the end caps 14, the end walls 110 of the main body 102 may be formed to include beveled corner regions adjacent respective ones of the sidewalls 108.

As is seen in FIGS. 3 and 4, the main body 102 of the scaffold plank 100 is formed to include four (4) channel members 112 which are integrally connected to the inner surface of the top wall 104 and extend longitudinally therealong in spaced, generally parallel relation to each other. The outermost pair of channel members 112 each have a generally L-shaped configuration and, in addition to being integrally connected to the inner surface of the top wall 104, are integrally connected to the inner surfaces of respective ones of the sidewalls 108. The central two channel members 112 each have a generally U-shaped configuration and are integrally connected to only the inner surface of the top wall 104. In the scaffold plank 100, the outermost pair of channel members 112 and inner surfaces of the top and sidewalls 104, 108 collectively define a pair of slots, with another pair of slots being collectively defined by the central two channel members 112 and inner surface of the top wall 104. Each of these four (4) slots has a generally rectangular configuration and extends substantially along the length of the main body 102. Additionally, each of these slots is sized and configured to accommodate a reinforcement bar 114 which is identically configured to the previously described reinforcement bar 36 and preferably fabricated from steel.

In addition to the channel members 112, integrally connected to and extending perpendicularly from the inner surface of the top wall 104 are three (3) longitudinally extending primary reinforcement webs 116. In the scaffold plank 100, each of the primary reinforcement webs 116 is disposed equidistantly between an adjacent pair of channel members 112 and extends in generally parallel relation thereto. Integrally connected to and extending angularly between each of the primary reinforcement webs 116 and the channel members 112 of the corresponding pair are a plurality of secondary reinforcement webs 118 which are also integrally connected to the inner surface of the top wall 104 and extend generally perpendicularly relative thereto. As is best seen in FIG. 4, the channel members 112 and primary and secondary reinforcement webs 116, 118 are each sized and configured such that the distal surfaces thereof (i.e., those surfaces disposed furthest from the inner surface of the top wall 104) and are oriented inwardly from the distal edges of the sidewalls 108 and end walls 110 (or end caps 14) of the main body 102. In this respect, the distal edges of the side and end walls 108, 110 of the main body 102 protrude slightly outwardly from the distal surfaces of the channel members 112 and primary and secondary reinforcement webs 116, 118 for reasons which will be described in more detail below.

In addition to the main body 102, the scaffold plank 100 of the second embodiment may comprise a cover member 120 which also has an elongate, generally rectangular configuration and define opposed, generally planar surfaces. In the scaffold plank 100, the cover member 120 is attached to the main body 102 such that the inner surface of the cover member 120 lies in abutting contact with the distal surfaces of the channel members 112 and primary and secondary reinforcements webs 116, 118. In this respect, the length and width dimensions of the cover member 120 are slightly smaller than those of the main body 102 such that when the inner surface of the cover member 120 is placed in abutting contact with the channel members 112 and primary and secondary reinforcement webs 116, 118 in the aforementioned manner, the outer surface of the cover member 120 is substantially flush or continuous with distal edges of the side and end walls 108, 110 of the main body 102.

The attachment of the cover member 120 to the main body 102 is preferably facilitated through the use of sonic welding, pins, or an adhesive. However, those of ordinary skill in the art will recognize that other methods may be employed to facilitate the attachment of the cover member 120 to the main body 102. Since the cover member 120, when attached to the main body 102, does not protrude beyond the side and end walls 108, 110 of the main body 102, the overall length, width and height dimensions of the scaffold plank 100 are governed by the main body 102 thereof. Though not shown, it is contemplated that a sealing strip will be compressed between the cover member 120 and the main body 102 when the cover member 120 is attached to the main body 102.

In the second embodiment, the preferred height or thickness of the main body 102, and hence the scaffold plank 100, is in the range of from about 1.0 inch to about 2.50 inches, and preferably about 1.50 inches. The preferred width of the main body 102 is in the range of from about 6.0 inches to about 15.0 inches, and is preferably about 9.50 inches. The overall length of the main body 102 is variable, with it being contemplated that the same may be provided in lengths of either 6 feet, 9 feet, 12 feet, or 16 feet.

Like the main body 12 and end caps 14 of the scaffold plank 10 of the first embodiment, both the main body 102 and cover member 120 of the scaffold plank 100 of the second embodiment are preferably fabricated from a plastic material. As is the first embodiment, a preferred plastic material is a ten percent to fifty percent glass-filled polypropylene/nylon blend. An alternative plastic material may be either virgin or recycled plastic. It is contemplated that the plastic or nylon material may be filled with either glass or another suitable reinforcement material to increase the structural integrity/rigidity thereof. As indicated above, each of the reinforcement bars 114 is preferably fabricated from steel. However, the reinforcement bars 114 as well as the above-described reinforcement bars 36 may each be fabricated from a material other than steel.

In the scaffold plank 100 shown in FIGS. 3 and 4, four (4) reinforcement bars 114 are depicted as being disposed within respective ones of the four (4) slots extending within the interior of the main body 102. Those of ordinary skill in the art will recognize that no reinforcement bars 114 need be provided within the main body 102, and that less than four (4) reinforcement bars 114 may be included therein. The number of reinforcement bars 114, if any, included in the interior of the main body 102 of the scaffold plank 100 is dependent upon the level of structural integrity or rigidity desired in relation thereto. Additionally, though the main body 102 is shown as including four (4) channel members 112 and three (3) primary reinforcement webs 116, those of ordinary skill in the art will recognize that the main body 102 may be formed to include greater or fewer channel members 112 and/or primary reinforcement webs 116.

As indicated above, no reinforcement bars 114 need to be provided within the main body 102. In this respect, it is contemplated that as an alternative to the reinforcement bars 114 being included in the main body 102, the channel members 112 may be formed to be of a solid cross-sectional configuration as opposed to partially defining the above-described rectangularly configured slots. In this respect, based upon the particular plastic material used to form the main body 102, the formation of the same with the solid channel members 102 may be sufficient to impart the desired amount of structural integrity/rigidity to the scaffold plank 100.

In the second embodiment, the main body 102 of the scaffold plank 100 is preferably fabricated via an injection molding process, as is the cover member 120 thereof. If one or more reinforcement bars 114 is to be included within the interior of the main body 102, such reinforcement bar(s) 114 will typically be pre-positioned within the mold, with the plastic material thereafter being injection molded about the same, thus resulting in the reinforcement bars 114 being molded in place. Additionally, as seen in FIG. 3, it is contemplated that the mold may be formed to provide the top surface 106 of the top wall 104 with non-skid characteristics through the formation of multiple, generally circular protuberances 122 thereon, with such protuberances 122 being arranged in generally parallel rows. As an alternative to being formed to include the protuberances 122, the top surface 106 of the top wall 104 may be subjected to a follow-up grinding or machining operation subsequent to the molding of the main body 102 for purposes of applying a texture or roughened feature thereto. The outer surface of the cover member 120 may also be formed to include a texture or roughened feature. Though the main body 102 and the cover member 120 are preferably fabricated via an injection molding process, it is contemplated that either or both of the main body 102 and cover member 120 may be fabricated via a vacuum forming or extrusion process. Additionally, though not shown, it is contemplated that the previously described nail holes 16 and/or frame setting notches 18 may be formed within the scaffold plank 100 via processes/techniques similar to those previously described in relation to the scaffold plank 10 of the first embodiment.

It is contemplated in the scaffold plank 100 of the second embodiment, the cover member 120 may be formed as an integral portion of the main body 102 as opposed to a separate component attached thereto. In this respect, the main body 102 including the cover member 120 as an integral portion thereof may be formed or fabricated as a totally symmetrical component or part. Both of the sides or faces of such symmetrical part could be provided with a texture or roughened feature, with the absence of any nail holes 16 and frame setting notches 18 allowing the same to be positioned upon scaffolding in any orientation. If formed to include the cover member 120 as an integral portion thereof, it is contemplated that the main body 102 will be molded in two identical halves defined by bisecting the side walls 108 along a common plane. These two symmetrical halves of the main body 102 (one of which would include the integrally formed cover member 120) would be attached to each other via sonic welding or an adhesive to facilitate the formation of the scaffold plank 100. Each of the symmetrical halves could be individually fabricated via injection molding, rotational molding, or a vacuum forming process.

Figures 5, 7:
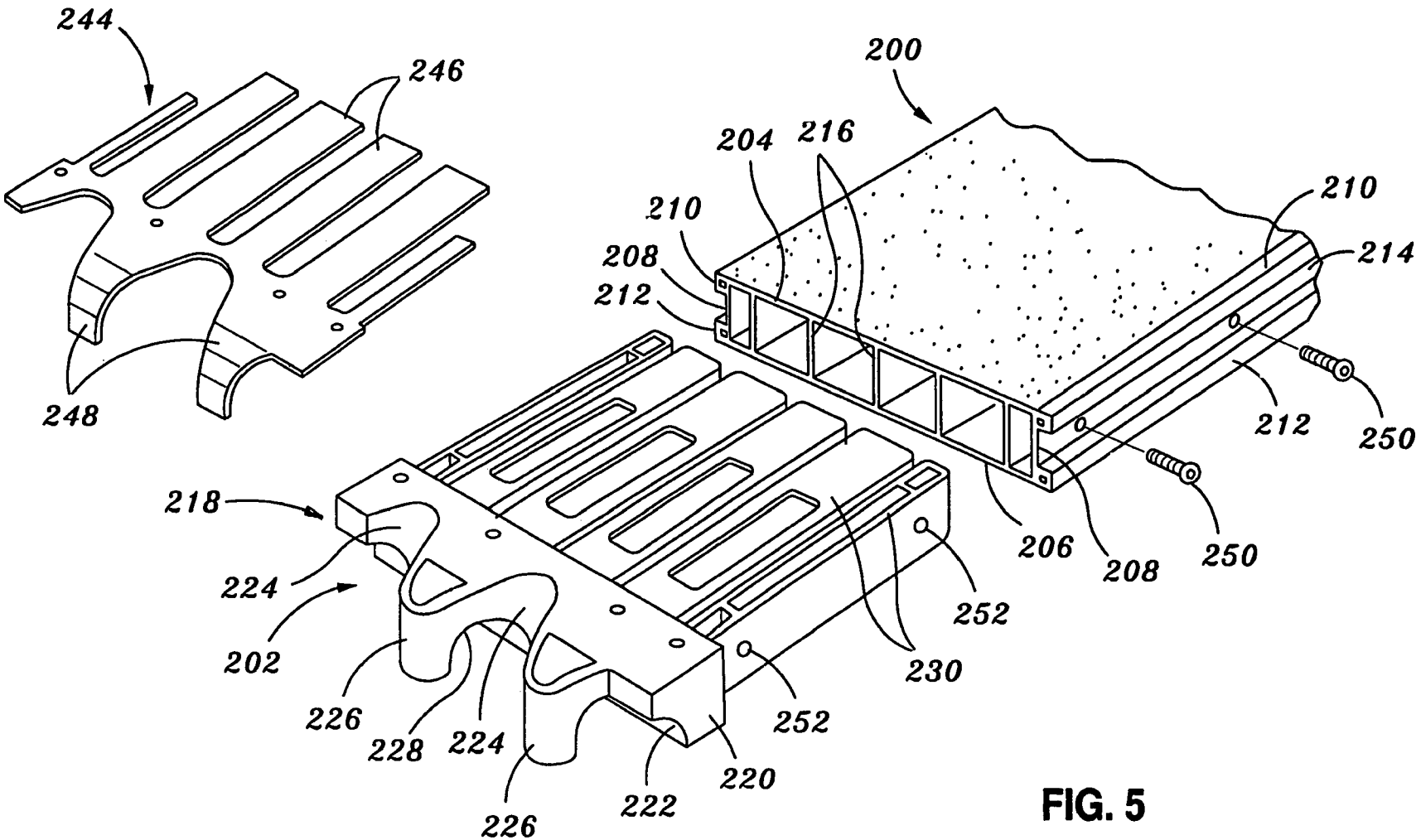
FIG. 5 is an exploded view of a scaffold plank constructed in accordance with a third embodiment of the present invention, and the end connector used in conjunction therewith.
FIG. 7 is a top perspective view of a steel reinforcement plate of the end connector shown in FIGS. 5 and 6.

Referring now to FIG. 5, there is shown a scaffold plank 200 constructed in accordance with a third embodiment to the present invention. The scaffold plank 200 is preferably outfitted with a pair of end connectors 202 which are cooperatively engaged to respective ones of the opposed ends of the scaffold plank 200. The structural and functional attributes of each end connector 202 (one of which is shown in FIG. 5 as exploded from the scaffold plank 200) will be described in more detail below.

As seen in FIG. 5, the scaffold plank 200 is preferably a unitary structure which defines a generally planar, sheet-like top wall 204 and a generally planar, sheet-like bottom wall 206. The top and bottom walls 204, 206 extend in spaced relation to each other along respective ones of a generally parallel pair of planes. Extending perpendicularly between corresponding pairs of the longitudinal edges of the top and bottom walls 204, 206 is a spaced, generally parallel pair of side walls 208. Though the inner surfaces of the side walls 208 are generally planar, the outer surfaces thereof each include an integral upper rail 210 and an integral lower rail 212 extending longitudinally therealong in spaced, generally parallel relation to each other. The upper rails 210 extend along respective ones of the opposed longitudinal sides of the top wall 204, and are each substantially flush with the outer surface of the top wall 204. Similarly, the lower rails 212 extend along respective ones of the opposed longitudinal sides of the bottom wall 206 and are each substantially flush with the outer surface of the bottom wall 206. As shown in FIG. 5, each of the upper and lower rails 210, 212 is preferably hollow, though the same may alternatively be formed to have solid cross-sectional configurations. Due to the inclusion of the upper and lower rails 210, 212 thereon, each side wall 208 defines an elongate slot 214, the use of which will also be discussed in more detail below.

The scaffold plank 200 further comprises a plurality of reinforcement walls 216 which extend perpendicularly between the inner surfaces of the top and bottom walls 204, 206. The reinforcement walls 216 extend longitudinally along the length of the scaffold plank 200 in spaced, generally parallel relation to each other. Though the reinforcement walls 216 are equidistantly spaced relative to each other, the spacing between the outermost pair of reinforcement walls 216 and respective ones of the side walls 208 is reduced in comparison to the spacing between the reinforcement walls 216. As a result, an outer pair of cavities collectively defined by the top and bottom walls 204, 206, outermost pair of reinforcement walls 216, and side walls 208 each have a width which is less than that of multiple inner cavities which are each collectively defined by the top and bottom walls 204, 206 and an adjacent pair of the reinforcement walls 216. As seen in FIG. 5, the scaffold plank 200 is formed to include five reinforcement walls 216. As a result, the scaffold plank 200 includes four inner cavities and two outer cavities which, as indicated above, are of reduced width as compared to the inner cavities. However, those of ordinary skill in the art will recognize that the number of reinforcement walls 216 included in the scaffold plank 200 as shown in FIG. 5 is exemplary only, in that greater or fewer reinforcement walls 216 may be formed to extend between the top and bottom walls 204, 206. Also exemplary is the spacing between the reinforcement walls 216, in that it is contemplated that the reinforcement walls 216 may be equidistantly spaced relative to each other and to the side walls 208, thus causing all of the cavities defined by the scaffold plank 200 to be of equal size.

It is contemplated that the scaffold plank 200 of the third embodiment will be fabricated in its entirety from a non-metal material via an extrusion or injection molding process. Exemplary materials for the scaffold plank 200 include various types of plastics (e.g., glass-filled polyethylene), fiber reinforced composites, or combinations thereof. In this regard, it is further contemplated that the extrusion process preferably used to facilitate the formation of the scaffold plank 200 may be carried out in a manner wherein various portions of the scaffold plank 200 are fabricated from a fiber reinforced plastic or composite, with other portions simply being fabricated from a non-reinforced plastic material. More particularly, depending on the level of structural integrity desired for the scaffold plank 200, one or more of the reinforcement walls 216 may be fabricated from a fiber reinforced composite material, with the remainder of the scaffold plank 200 being fabricated from a plastic material. As indicated above, the extrusion process preferably used to facilitate the formation of the scaffold plank 200 may be completed such that the scaffold plank 200 is a unitary structure, despite proscribed areas of the scaffold plank 200 being fabricated from differing non-metallic materials. As a further variation, the scaffold plank 200 as shown in FIG. 5 may be fabricated entirely from a non-reinforced plastic material, with reinforcing sheets of a fiber reinforced composite material being applied to the outer surface of the top wall 204 and/or the outer surface of the bottom wall 206 for purposes of increasing the structural integrity/rigidity of the scaffold plank 200. In the scaffold plank 200, the outer surface of the top wall 204 and the outer surface of the bottom wall 206 are preferably formed to have a roughened or textured feature to provide the scaffold plank 200 with non-slip characteristics. However, those of ordinary skill in the art will recognize that the non-skid, roughened texture may be included on only the outer surface of the top wall 204.

Figure 6:
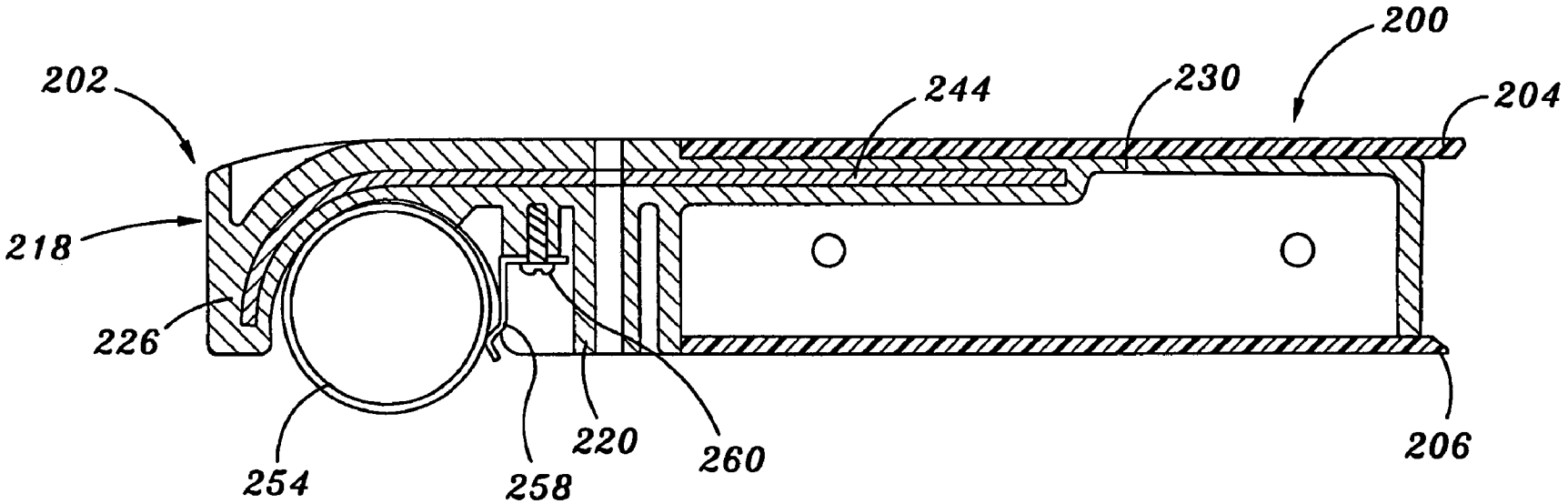
FIG. 6 is a cross-sectional view of the end connector shown in FIG. 5, further illustrating the manner in which the end connector is engaged to a segment of a support frame structure.

Referring now to FIGS. 5–7, as indicated above, the scaffold plank 200 of the third embodiment preferably includes a pair of end connectors 202 cooperatively engaged to respective ones of each of the opposed ends thereof. Each end connector 202 includes an engagement portion 218 having a main body 220 which defines an arcuate, generally concave body surface 222. The body surface 222 spans approximately ninety degrees. Formed within the main body 220 is a spaced pair of notches 224, each of which has a generally V-shaped configuration defining an arcuate lower apex. In addition to the main body 220, the engagement portion 218 of the end connector 202 includes a spaced, identically configured pair of arms 226 which are integrally connected to the main body 220. Each of the arms 226 defines an arcuate, generally concave arm surface 228 which, like the body surface 222, also spans approximately ninety degrees. The main body 220 and arms 226 are oriented relative to each other such that one of the notches 224 is disposed between the arms 226, with the remaining notch 224 being disposed between one arm 226 and one lateral end of the main body 220. Importantly, the main body 220 and arms 226 are oriented relative to each other such that the arms surfaces 228 of the arms 226 are continuous with the body surface 222 of the main body 220. Thus, the arms surfaces 228 and portions of the body surface 222 collectively define engagement surfaces which span, in total, approximately 180°. Each arm 226 also has a generally V-shaped configuration when viewed from a top perspective, with the side walls of the arm 26 oriented between the notches 224 being continuous with the side walls of such notches 224. One side wall of the remaining arm 226 is continuous with the side wall of the notch 224 disposed between the arms 226. As seen in FIG. 5, due to the shape of the engagement portion 218 of the end connector 202, the depth of the notch 224 located between the arms 226 appears to be greater than that of the remaining notch 224 due to the side wall of the notch 224 between the arms 226 being continuous with one side wall of each of the arms 226.

In addition to the engagement portion 218, the end connector 202 includes a plurality of elongate attachment fingers 230 which protrude perpendicularly from the side of the main body 220 opposite that including the body surface 222 formed therein. The fingers 230 extend in spaced, generally parallel relation to each other, and are each preferably hollow. As is best seen in FIG. 5, the fingers 230 are sized and configured to be advanceable into respective ones of the cavities defined by the scaffold plank 200. In this regard, since the cavities of the scaffold plank 200 are of differing widths as indicated above, the outermost pair of fingers 230 of the end connector 202 are of reduced width as compared to the remaining fingers 230. In this regard, the outermost pair of fingers 230 are sized and configured to be advanceable into respective ones of the outer pair of cavities defined by the scaffold plank 200, with the remaining fingers 230 being sized and configured to be advanceable into respective ones of the inner cavities defined by the scaffold plank 200. The advancement of the fingers 230 into respective ones of the cavities is limited by the abutment of a peripheral portion of the surface of the main body 220 from which the fingers 230 extend against corresponding lateral edges of the top and bottom walls 204, 206 and side walls 208 of the scaffold plank 200, in the manner shown in FIG. 6.

It s contemplated that the end connector 202 will be fabricated from a plastic material via an injection molding process, with the attachment fingers 230 being integrally connected to the main body 220 of the engagement portion 218. As seen in FIGS. 6 and 7, it is further contemplated that the structural integrity of each end connector 202 may optionally be increased through the inclusion of a reinforcement plate 244 therein. The reinforcement 244 is preferably fabricated from a metal material (e.g., steel), and has a shape which is complimentary to that of the main body 220, arms 226, and fingers 230. More particularly, the reinforcement plate 244 includes a plurality of reinforcement fingers 246 which are sized and configured to be advanceable into the interiors of respective ones of the attachment fingers 230. Additionally, the reinforcement plate 244 includes a pair of arcuate reinforcement arms 248 which are extensible into the interiors of respective ones of the arms 226. Since the end connector 202 is preferably fabricated via an injection molding process, it is contemplated that the reinforcement plate 244 will initially be included in the mold cavity, with the plastic material used to form the remainder of the end connector 202 being injected into the mold cavity in a manner effectively encapsulating the reinforcement plate 244 in the manner shown in FIG. 6.

As indicated above, the cooperative engagement of each end connector 202 to a respective end of the scaffold plank 200 is facilitated by the advancement of the fingers 230 of the end connector 202 into respective ones of the elongate cavities defined by the scaffold plank 200, such advancement terminating when the end of the scaffold plank 200 is abutted against the main body 220 of the engagement portion 218 in the above-described manner. It is contemplated that each end connector 202 will be maintained in firm engagement to the scaffold plank 200 through the use of multiple fasteners such as screws 250. As seen in FIGS. 5 and 6, one pair of screws 250 is advanced through respective ones of a pair of openings disposed within one side wall 208 of the scaffold plank 200 and into respective ones of a complimentary pair of internally threaded apertures 252 disposed within one of the outer pair of fingers 230 of the end connector 202. A second pair of screws 250 is extended through openings in the remaining side wall 208 and into a complimentary pair of internally threaded apertures 252 disposed in the remaining finger 230 of the outer pair. Since the openings in the side walls 208 of the scaffold plank 200 are disposed within the bottom surfaces of respective ones of the slots 214, the heads of the screws 250 do not protrude beyond the outermost surfaces of the upper and lower rails 210, 212 of each side wall 208, i.e., the heads of the screws 250 are effectively contained within respective ones of the slots 214. It is contemplated that the mechanical interlock between the end connectors 202 and scaffold plank 200 facilitated by the screws 250 may be supplemented by the application of an adhesive to prescribed portions of each end connector 202 prior to the advancement of the attachment fingers 230 thereof into the interior of the scaffold plank 200. Additionally, the screws 250 may be omitted in their entirety as a result of the use of an adhesive.

Figure 8:
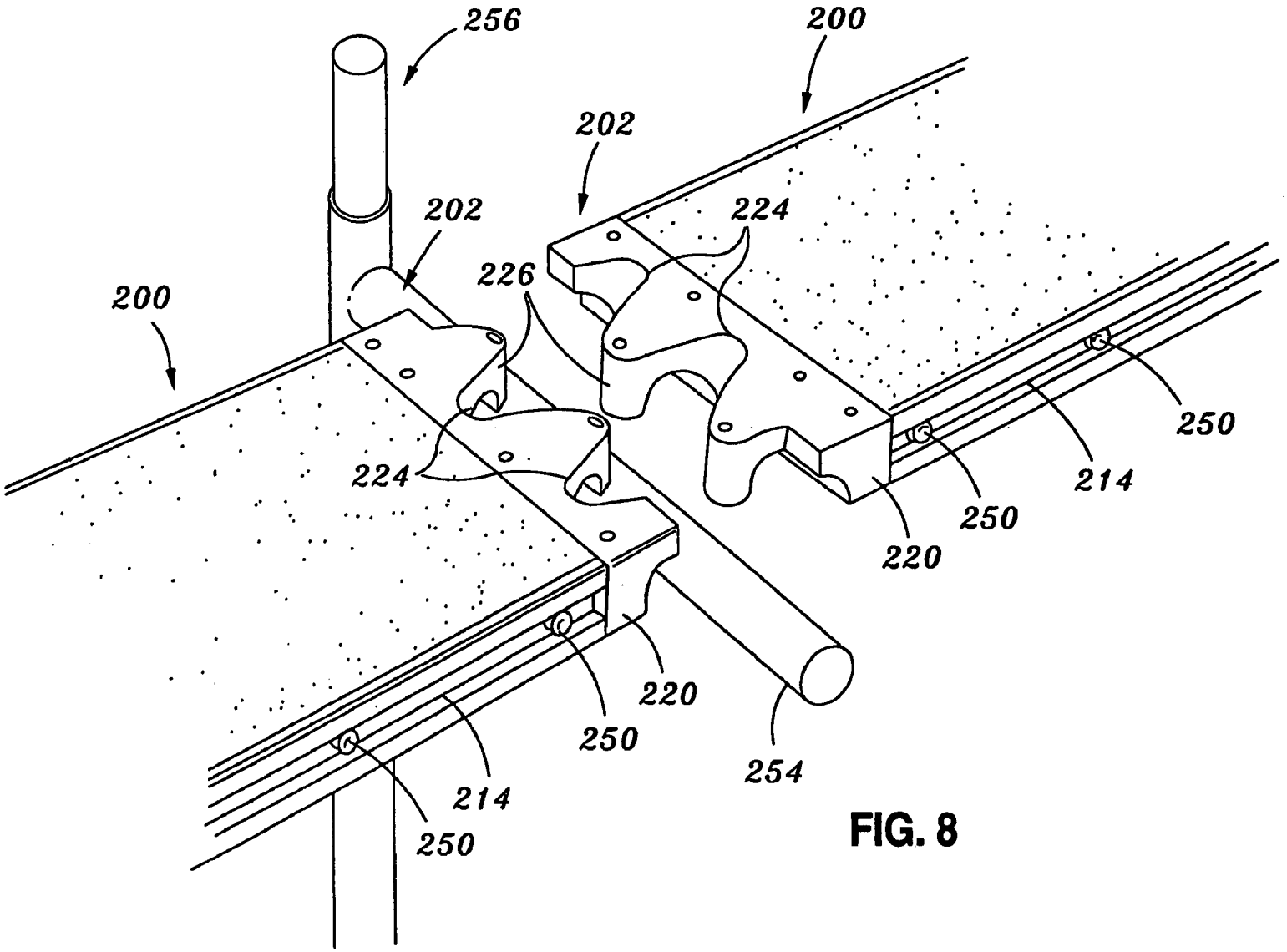
FIGS. 8 and 9 are top perspective views illustrating the manner in which the scaffold planks of the third embodiment including the end connectors shown in FIGS. 5–7 are interfaced to a support frame structure.
Figure 9:
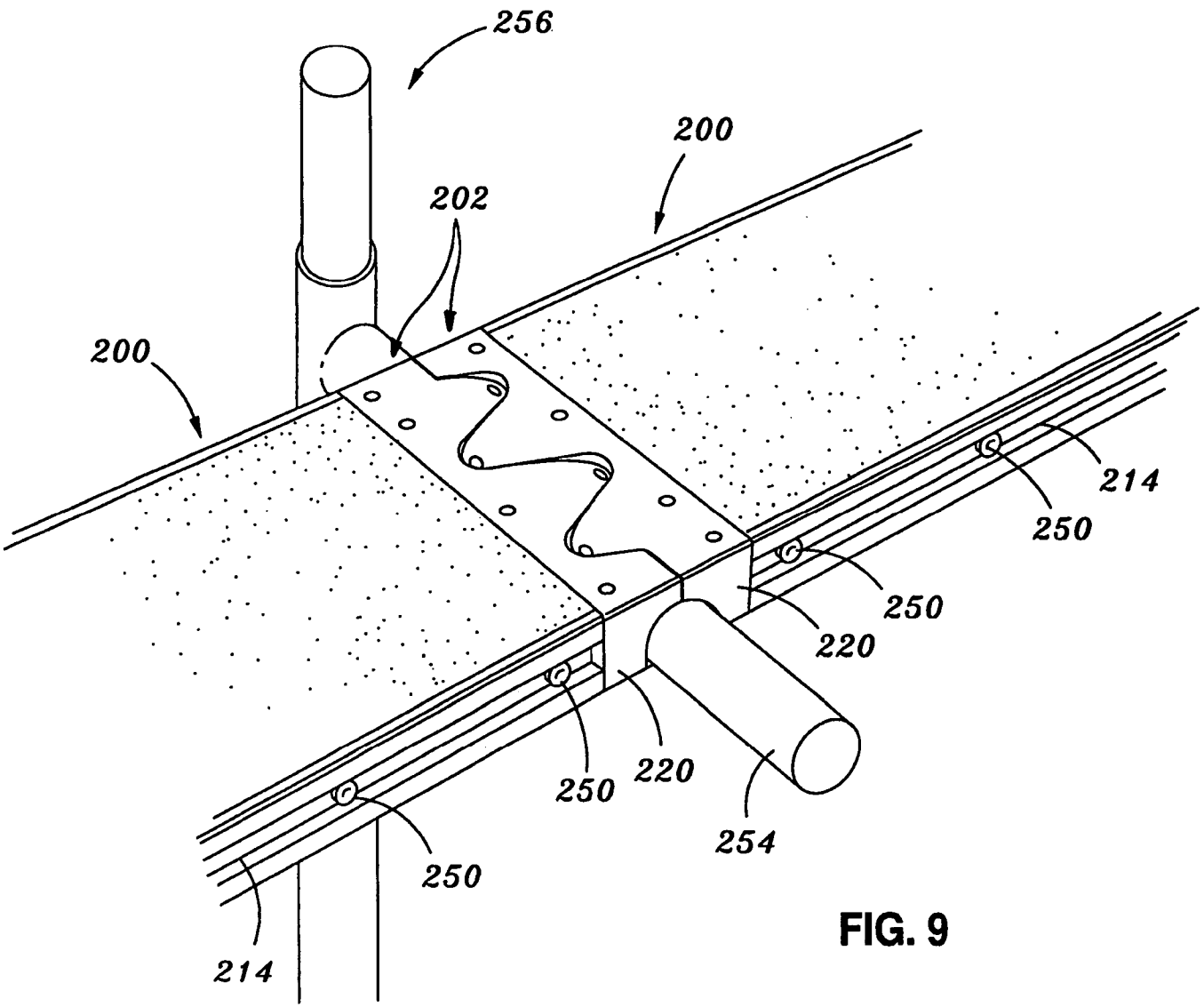

FIGS. 8 and 9 depict the manner in which a pair of scaffold planks 200 which each include the end connectors 202 attached to each of the opposed ends thereof are interfaced to a horizontal support bar 254 of a scaffolding support frame 256. As seen in FIGS. 6, 8 and 9, the end connector 202 is engaged to the support bar 254 such that the arms 226 extend about the support bar 254. More particularly, the outer surface of the support bar 254 is abutted directly against the arcuate body surface 222 of the main body 220 and against the arms surfaces 228 of the arms 226. Advantageously, since the body surface 222 spans the entire length of the main body 220, the scaffold plank 200 is not susceptible to rocking or tipping when weight or downward force is applied to the longitudinal edges thereof.

Once one end connector 202 of one scaffold plank 200 is cooperatively engaged to the support bar 254 in the above-described manner, one end connector 202 of the remaining scaffold plank 200 is itself cooperatively engaged to the same support bar 254. In this regard, the arms 226 of the end connector 202 of one scaffold plank 200 are nested into respective ones of the notches 224 of the corresponding end connector 202 of the other scaffold plank 200 in the manner shown in FIG. 9. When the corresponding end connectors 202 of the scaffold planks 200 are interfaced to the common support bar 254 as shown in FIG. 9, the contours of the top surfaces of the arms 226 results in the distal portions thereof being recessed downwardly relative to the top surfaces of the main bodies 220 of the engagement portions 218 of the corresponding end connectors 202.

As seen in FIG. 6, further in accordance with the present invention, it is contemplated that each end connector 202 of each scaffold plank 200 may optionally be provided with a locking clip 258 which is preferably fabricated from a resilient metallic material (e.g., steel) and secured to the main body 220 of the engagement portion 218 via one or more fasteners such as screws 260. It will be recognized that each end connector 202 may be outfitted with one relatively large locking clip 258, or multiple, smaller identically configured locking clips 258 disposed in spaced relation to each other. The locking clip 258 is sized and configured to frictionally engage the support bar 254 in the manner shown in FIG. 6, thus inhibiting the easy uplift of the end connector 202 out of engagement to the support bar 254. Those of ordinary skill in the art will recognize that the inclusion of the locking clip(s) 258 are optional, and that alternative locking mechanisms may be included in each end connector 202 to facilitate the secure connection thereof to the scaffolding support frame 256.

Figure 10:
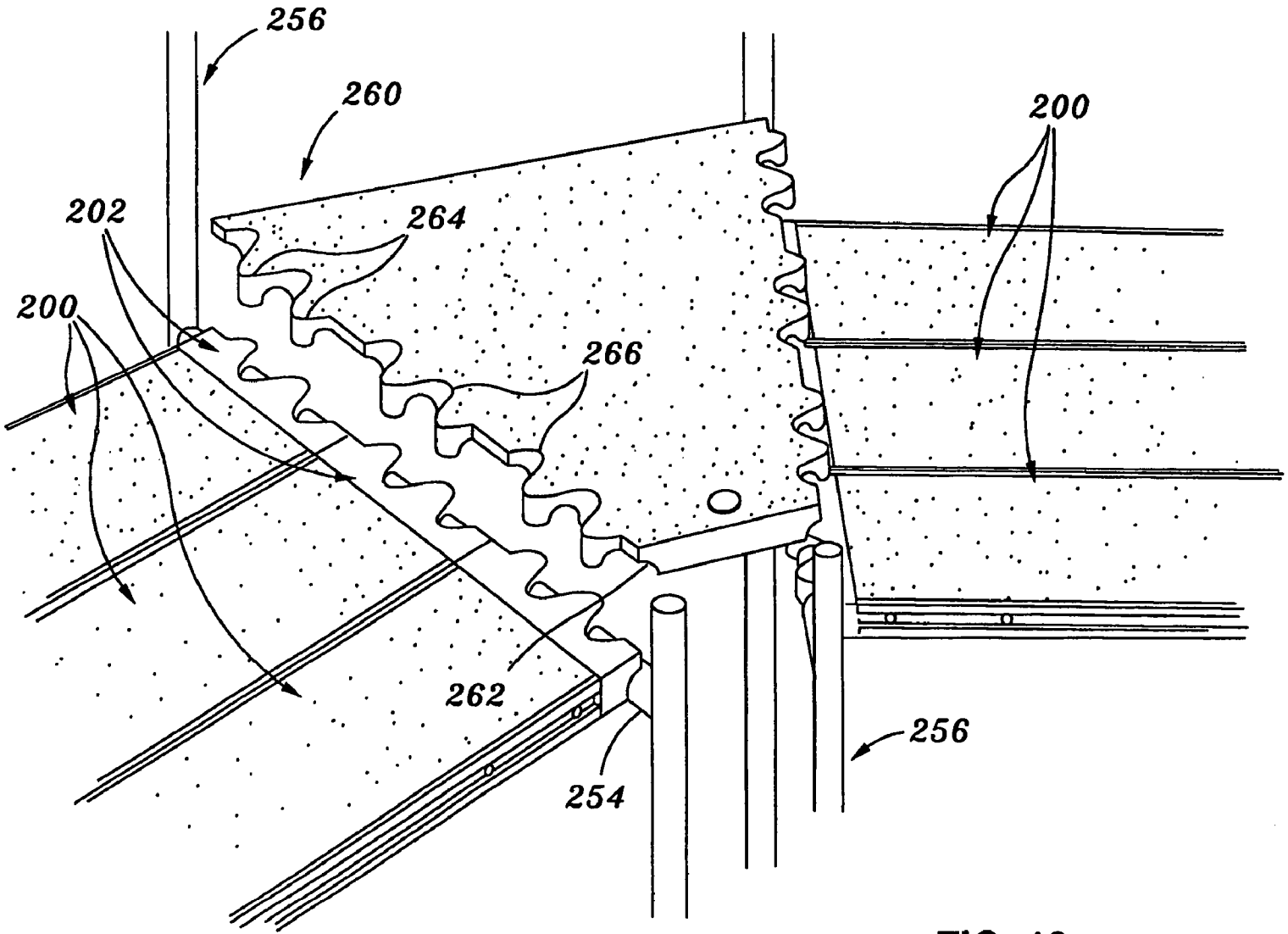
FIG. 10 is a perspective view illustrating the manner in which scaffold planks of the third embodiment and the corresponding end connectors may be interfaced to a support frame structure in side-by-side relation, and further illustrating an optional corner connector which may be used in conjunction with the scaffold planks of the third embodiment.

Referring now to FIG. 10, further in accordance with the present invention, it is contemplated that the slots 214 included in the side walls 208 of each scaffold plank 200 may be used to accommodate edge connectors (not shown) which effectively maintain two or more scaffold planks 200 in side-by-side attachment to each other, i.e., the longitudinal side wall 208 of one scaffold plank 200 is cooperatively engaged to a corresponding side wall 200 of an adjacent scaffold plank 200. In FIG. 10, three scaffold planks 200 are shown in such side-by-side engagement, with the end connectors 202 of each set of three interconnected scaffold planks 200 themselves being cooperatively engaged to a common horizontal support bar 254 of the scaffolding support frame 256. As further shown in FIG. 10, it is also contemplated that a corner connector 260 may be used in conjunction with two interconnected sets of scaffold planks 200, the corner connector 260 being sized and configured to allow the interconnected sets of scaffold planks 200 to be effectively joined to each other, despite being disposed at a prescribed angular displacement relative to each other. As shown in FIG. 10, the corner connector 260 includes an opposed pair of side edges, each of which is formed to include an arcuate, generally concave engagement surface 262, a plurality of arms 264, and a plurality of notches 266. The engagement surface 262, arms 264 and notches 266 of each side edge are structurally and functionally identical to the body surface 222, notches 224, and arms 226 of each end connector 202. In this regard, when the end connectors 202 of the interconnected scaffold planks 200 of one set are cooperatively engaged to the common support bar 254, one side edge of the corner connector 260 may be cooperatively engaged to the same support bar 254, with the arms 264 of the corner connector 260 being nested within respective ones of the notches 224 of the interconnected scaffold planks 200, and the arms 226 of the interconnected scaffold planks 200 being nested within respective ones of the notches 266 of the corner connector 260.

The corner connector 260 is preferably fabricated from a plastic material via an injection molding process, with the top surface of the corner connector 260 also being provided with a roughened, non-slip texture. As seen in FIG. 10, the corner connector 260 is sized to span approximately 30°, though those of ordinary skill in the art will recognize that the corner connector 260 may be formed to span differing angular intervals. Additionally, multiple corner connectors 260 may be cooperatively engaged to the scaffolding support frame 256 proximate to each other so as to collectively define a span of more than 30°. For example, two corner connectors 260 as shown in FIG. 10 disposed in side-by-side relation to each other would span approximately 60°, with three corner connectors 260 interlocked to the scaffolding support frame 256 in side-by-side relation to each other spanning approximately 90°. Though the corner connector 260 shown in FIG. 10 is shown as being sized to be interfaced to two sets of three interconnected scaffold planks 200, the corner connector 260 may alternatively be sized and configured to span between only two interconnected scaffold planks 200, or even individual scaffold planks 200 which are angularly displaced relative to each other.

Additional modifications and improvements of the present invention may also be apparent to those of ordinary skill in the art. In this respect, the planks formed in accordance with the present invention may be used in applications other than for scaffolding. Thus, the particular combination of parts described and illustrated herein is intended to represent only certain embodiments of the present invention, and is not intended to serve as limitations of alternative devices within the spirit and scope of the invention

What is claimed is:

1. A corner connector for use in conjunction with a pair of scaffold planks disposed on a scaffolding frame at a prescribed angular displacement relative to each other, the corner connector comprising:

a corner connector body defining a front edge, a back edge, and a spaced pair of side edges, each of the side edges being formed to include an arcuate, generally concave corner connector body engagement surface; and at least two corner connector arms protruding from each of the side edges of the corner connector body, each of the corner connector arms defining an arcuate corner connector arm engagement surface which is substantially continuous with a respective one of the corner connector body engagement surfaces;

the corner connector body and arm engagement surfaces being sized and configured to be cooperatively engageable to the scaffolding frame, wherein each of the side edges of the corner connector body further includes at least two corner connector notches formed therein which each have a shape complimentary to one of the corner connector arms.

2. The corner connector of claim 1 wherein the corner connector is fabricated from a non-metal material.

3. The corner connector of claim 1 wherein:

the front edge is of a first length; and the back edge extends in generally parallel relation to the front edge, and is of a second length which exceeds the first length.

4. The corner connector of claim 3 wherein the side edges of the corner connector body are separated from each other at an angular interval in a range of from approximately 30° to approximately 90°.

5. The corner connector of claim 1 wherein the corner connector body further defines a top surface having a roughened, non-slip texture.

6. The corner connector of claim 1 wherein at least one of the corner connector notches formed within each of the side edges is disposed between a respective pair of the corner connector arms.

7. The corner connector of claim 1 wherein the corner connector arms are each integrally connected to respective ones of the side edges of the corner connector body.

8. A scaffolding system for engagement to a scaffolding frame, the scaffolding system comprising:

at least two scaffold planks disposed on the scaffolding frame at a prescribed angular displacement relative to each other, each of the scaffold planks comprising:

an elongate, non-metal plank defining opposed first and second ends; and a pair of end connectors attached to respective ones of the opposed ends of the plank, each of the end connectors including:

an end connector body defining an arcuate end connector body engagement surface;

at least two end connector arms attached to the end connector body, each of the end connector arms defining an arcuate end connector arm engagement surface which is substantially continuous with the end connector body engagement surface; and at least two end connector notches formed in the end connector body, each of the end connector notches having a shape which is complimentary to one of the end connector arms;

the end connector body and arm engagement surfaces being sized and configured to be cooperatively engageable to the scaffolding frame;

at least one corner connector including:

a corner connector body defining a front edge, a back edge, and a spaced pair of side edges, each of the side edges being formed to include an arcuate, generally concave corner connector body engagement surface;

at least two corner connector arms protruding from each of the side edges of the corner connector body, each of the corner connector arms defining an arcuate corner connector arm engagement surface which is substantially continuous with a respective one of the corner connector body engagement surfaces and having a shape which is complementary to the end connector notches; and at least two corner connector notches formed within each of the side edges, each of the corner connector notches having a shape which is complimentary to one of the end connector arms;

the corner connector being cooperatively engageable to the scaffolding frame and extensible between the scaffold planks, with the corner connector arms being matingly receivable into respective ones of the end connector notches of an adjacent, corresponding pair of the end connectors and the end connector arms being matingly receivable into respective ones corner connector notches within an adjacent, corresponding one of the side edges of the corner connector body.

9. The scaffolding system of claim 8 wherein the corner connector is fabricated from a non-metal material.

10. The scaffolding system of claim 8 wherein:

the front edge of the corner connector body is of a first length; and the back edge of the corner connector body extends in generally parallel relation to the front edge, and is of a second length which exceeds the first length.

11. The scaffolding system of claim 10 wherein the side edges of the corner connector body are separated from each other at an angular interval in a range of from approximately 30° to approximately 90°.

12. The scaffolding system of claim 8 wherein the corner connector body of the corner connector further defines a top surface having a roughened, non-slip texture.

13. The scaffolding system of claim 8 wherein at least one of the corner connector notches formed within each of the side edges of the corner connector body is disposed between a respective pair of the corner connector arms.

14. The scaffolding system of claim 8 wherein the corner connector arms are each integrally connected to respective ones of the side edges of the corner connector body.

15. A corner connector for use in conjunction with a pair of scaffold planks disposed on a scaffolding frame, the corner connector comprising:

a corner connector body defining a spaced pair of side edges, each of the side edges being formed to include an arcuate, generally concave corner connector body engagement surface;

a plurality of corner connector arms protruding from each of the side edges of the corner connector body, each of the corner connector arms defining an arcuate corner connector arm engagement surface which is substantially continuous with a respective one of the corner connector body engagement surfaces; and a plurality of corner connector notches formed within each of the side edges, each of the corner connector notches having a shape which is complimentary to one of the corner connector arms, with at least some of the corner connector notches being disposed between respective pairs of the corner connector arms;

the corner connector body and arm engagement surfaces being sized and configured to be cooperatively engageable to the scaffolding frame.

16. The corner connector of claim 15 wherein the corner connector is fabricated from a non-metal material.

17. The corner connector of claim 15 wherein:

the corner connector body further defines a front edge and a back edge which each extend between the side edges;

the front edge is of a first length; and the back edge extends in generally parallel relation to the front edge, and is of a second length which exceeds the first length.

18. The corner connector of claim 17 wherein the side edges of the corner connector body are separated from each other at an angular interval in a range of from approximately 30° to approximately 90°.

19. The corner connector of claim 15 wherein the corner connector body further defines a top surface having a roughened, non-slip texture.

* * * * *